US010696045B2

(12) United States Patent
Nishikori et al.

(10) Patent No.: US 10,696,045 B2
(45) Date of Patent: Jun. 30, 2020

(54) RECORDING APPARATUS AND RECORDING METHOD

(71) Applicant: CANON KABUSHIKI KAISHA, Tokyo (JP)

(72) Inventors: Hitoshi Nishikori, Inagi (JP); Tetsuya Edamura, Inagi (JP); Masashi Hayashi, Yokohama (JP); Eiji Komamiya, Kawasaki (JP); Kentaro Muro, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/988,941

(22) Filed: May 24, 2018

(65) Prior Publication Data

US 2018/0354260 A1 Dec. 13, 2018

(30) Foreign Application Priority Data

Jun. 13, 2017 (JP) ..... 2017-115989

(51) Int. Cl.

| | |
|---|---|
| ***B41J 2/045*** | (2006.01) |
| ***B41J 2/18*** | (2006.01) |
| ***B41J 2/175*** | (2006.01) |
| ***B41J 2/195*** | (2006.01) |

(52) U.S. Cl.

CPC ..... *B41J 2/04573* (2013.01); *B41J 2/04506* (2013.01); *B41J 2/04586* (2013.01); *B41J 2/175* (2013.01); *B41J 2/18* (2013.01); *B41J 2/195* (2013.01)

(58) Field of Classification Search

CPC ..... B41J 2/195; B41J 2/175; B41J 2/18; B41J 2/165; B41J 2/04508; B41J 2/04535; B41J 2/04538; B41J 2/04563; B41J 2/04571; B41J 2/04573

See application file for complete search history.

(56) References Cited

FOREIGN PATENT DOCUMENTS

| | | | | |
|---|---|---|---|---|
| JP | 2007-144966 A | | 6/2007 | |
| JP | 2014-531349 A | | 11/2014 | |
| JP | 2017121788 | * | 7/2017 | ..... B41J 2/165 |

* cited by examiner

*Primary Examiner* — Kristal Feggins

(74) *Attorney, Agent, or Firm* — Canon U.S.A., Inc. IP Division

(57) ABSTRACT

A recording apparatus includes a recording head, a circulation channel, a concentration acquisition unit, an adjustment unit, and a control unit. The recording head includes a plurality of discharge ports through which ink is discharged and a pressure chamber being in communication with the plurality of discharge ports. The circulation channel is in communication with the pressure chamber to circulate the ink between the pressure chamber and an external portion thereof such that the ink is supplied to and collected from the pressure chamber. The concentration acquisition unit is configured to acquire concentration information about an ink concentration in the circulation channel. The adjustment unit is configured to adjust a timing to discharge the ink based on the concentration information. The control unit is configured to control a recording operation of recording by discharging the ink from the recording head such that the ink is discharged at the adjusted timing.

11 Claims, 15 Drawing Sheets

FIG.11

| INK | DISCHARGE TIMING ADJUSTMENT VALUE | |
|---|---|---|
| | 0 | -1 |
| Bk | LESS THAN 8% | 8% OR MORE |
| Cy | LESS THAN 7.5% | 7.5% OR MORE |
| Ma | LESS THAN 7.5% | 7.5% OR MORE |
| Ye | LESS THAN 7.5% | 7.5% OR MORE |

FIG.13

| INK | HEAD-TO-MEDIUM DISTANCE | |
|---|---|---|
| | h1 | h2 (< h1) |
| Bk | LESS THAN 8% | 8% OR MORE |
| Cy | LESS THAN 7.5% | 7.5% OR MORE |
| Ma | LESS THAN 7.5% | 7.5% OR MORE |
| Ye | LESS THAN 7.5% | 7.5% OR MORE |

RECORDING APPARATUS AND RECORDING METHOD

BACKGROUND OF THE INVENTION

Field of the Invention

One disclosed aspect of the embodiments relates to a recording apparatus and a recording method.

Description of the Related Art

Recording apparatuses which record images on recording mediums using a recording head including a plurality of discharge ports through which ink is discharged are known. In such a recording apparatus, ink is discharged from the recording head at predetermined timings while the recording head or recording medium is moved so that the ink is applied onto the recording medium.

In the above-described recording apparatuses, the discharge speed of ink from the recording head can decrease due to ink concentration, etc. If the discharge speed decreases, the effect of the movement speed of the recording head or recording medium becomes relatively large, so that the ink can land onto a position deviated from an ideal position onto which the ink is supposed to land. In response thereto, Japanese Patent Application Laid-Open No. 2007-144966 discusses a technique for adjusting the timing to discharge ink for each nozzle based on driving pause intervals in a case in which the discharge speed changes depending on the driving pause intervals.

Meanwhile, recording apparatuses including circulation channels such as those discussed in Japanese Unexamined Patent Application Publication (Translation of PCT Application) No. 2014-531349 have been known in recent years. The vicinities of discharge ports are in communication with the outside through the circulation channels, and ink is circulated between the vicinities of the discharge ports and the outside thereof to prevent the discharge ports from being clogged.

When a recording apparatus including circulation channels is used, even if ink is concentrated in the vicinities of discharge ports as a result of moisture evaporation in ink, the concentrated ink is sent outside through the circulation channel, so that the discharged ink is able to maintain a relatively low concentration.

However, the ink sent outside continues to be circulated in the circulation channels to cause the ink to be gradually concentrated in the circulation channels. Consequently, the concentration of the ink in the circulation channels increases over time, which causes a gradual increase in the concentration of the ink supplied to the vicinities of the discharge ports. An increase in the ink concentration can lead to a change in the discharge speed. In such a case, the landing position of the ink gradually deviates from the originally-determined ideal position.

The technique discussed in Japanese Patent Application Laid-Open No. 2007-144966 uses the driving pause intervals as an index to correct deviations of the ink landing positions, but what is calculable from the driving pause intervals is only an amount of change in the concentration until a recovery from a pause in the driving. Specifically, the technique discussed in Japanese Patent Application Laid-Open No. 2007-144966 is not capable of acquiring the level of ink concentration in the circulation channels which is caused by the circulation described above. Thus, the technique discussed in Japanese Patent Application Laid-Open No. 2007-144966 is not capable of suitably correcting deviations of the landing positions of the ink which are caused by ink concentration in the circulation channels.

SUMMARY OF THE INVENTION

The disclosure is directed to a technique for suitably correcting deviations of landing positions of ink which are caused by ink concentration in circulation channels.

According to an aspect of the embodiments, a recording apparatus includes a recording head, a circulation channel, a concentration acquisition unit, an adjustment unit, and a control unit. The recording head includes a plurality of discharge ports through which ink is discharged and a pressure chamber being in communication with the plurality of discharge ports. The circulation channel is in communication with the pressure chamber to circulate the ink between the pressure chamber and an external portion thereof so that the ink is supplied to and collected from the pressure chamber. The concentration acquisition unit is configured to acquire concentration information about an ink concentration in the circulation channel. The adjustment unit is configured to adjust a timing to discharge the ink based on the concentration information. The control unit is configured to control a recording operation of recording by discharging the ink from the recording head such that the ink is discharged at the timing adjusted by the adjustment unit.

Further features of the disclosure will become apparent from the following description of exemplary embodiments (with reference to the attached drawings).

BRIEF DESCRIPTION OF THE DRAWINGS

FIG. 11 illustrates the relationship between concentrations and discharge timing adjustment values according to an exemplary embodiment.

FIG. 13 illustrates the relationship between concentrations and head-to-medium distances according to an exemplary embodiment.

DESCRIPTION OF THE EMBODIMENTS

Figure 1:
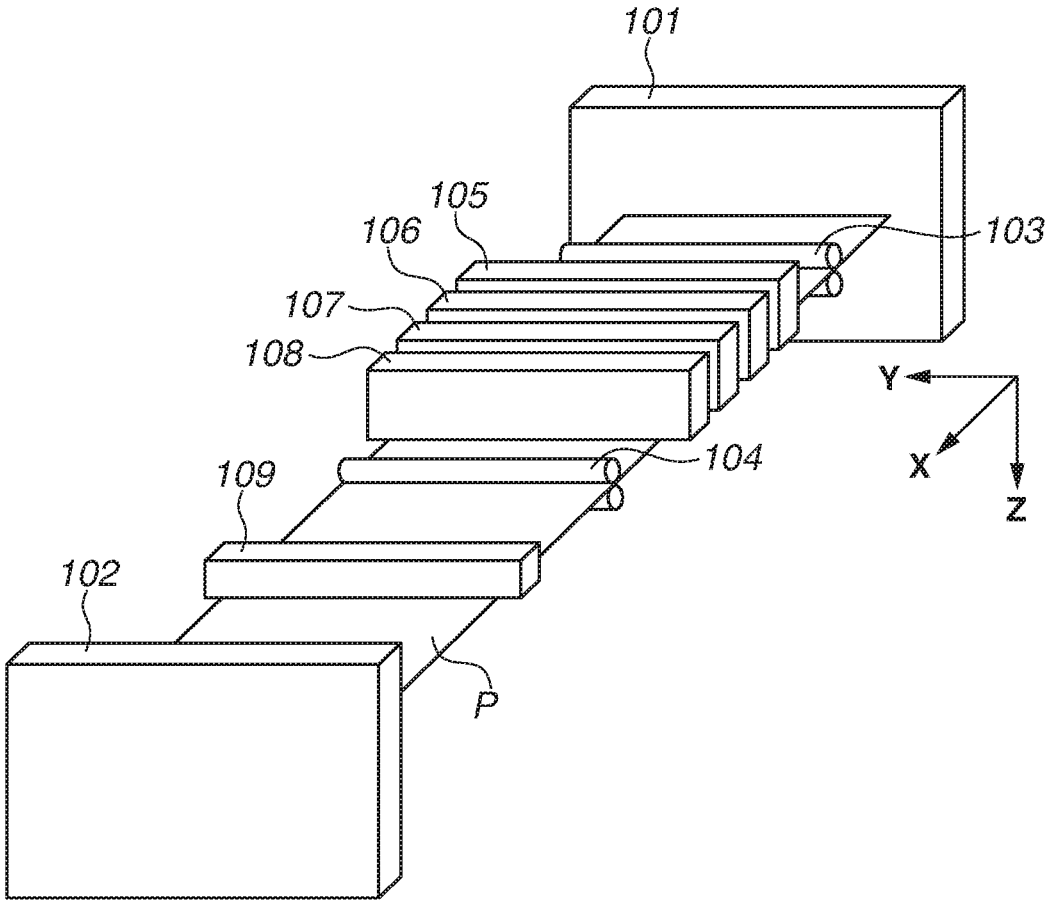
FIG. 1 illustrates an internal structure of a recording apparatus according to an exemplary embodiment.

A first exemplary embodiment will be described below. FIG. 1 illustrates the internal structure of an inkjet recording apparatus (hereinafter, "recording apparatus") according to the present exemplary embodiment.

A recording medium P fed from a sheet feeding portion 101 is conveyed in a positive X-direction (sheet conveyance direction, intersection direction) at a predetermined speed while being sandwiched by a pair of sheet conveyance rollers 103 and 104, and then the recording medium P is ejected to a sheet ejection portion 102. Between the sheet conveyance roller 103 located on the upstream side and the sheet conveyance roller 104 located on the downstream side are aligned recording heads 105 to 108 along the sheet conveyance direction, and the recording heads 105 to 108 discharge ink in a positive Z-direction according to recording data. The recording heads 105, 106, 107, and 108 discharge cyan, magenta, yellow, and black inks, respectively.

In the present exemplary embodiment, the recording medium P can be a continuous sheet stored in a roll shape in the sheet feeding portion 101 or a cut sheet which is cut in advance into a standard size. In the case in which the recording medium P is a continuous sheet, the recording medium P is cut into a predetermined length by a cutter 109 after the end of a recording operation by the recording heads 105 to 108 and then sorted by size and ejected onto a sheet ejection tray by the sheet ejection portion 102.

(Recording Head)

Figure 2:
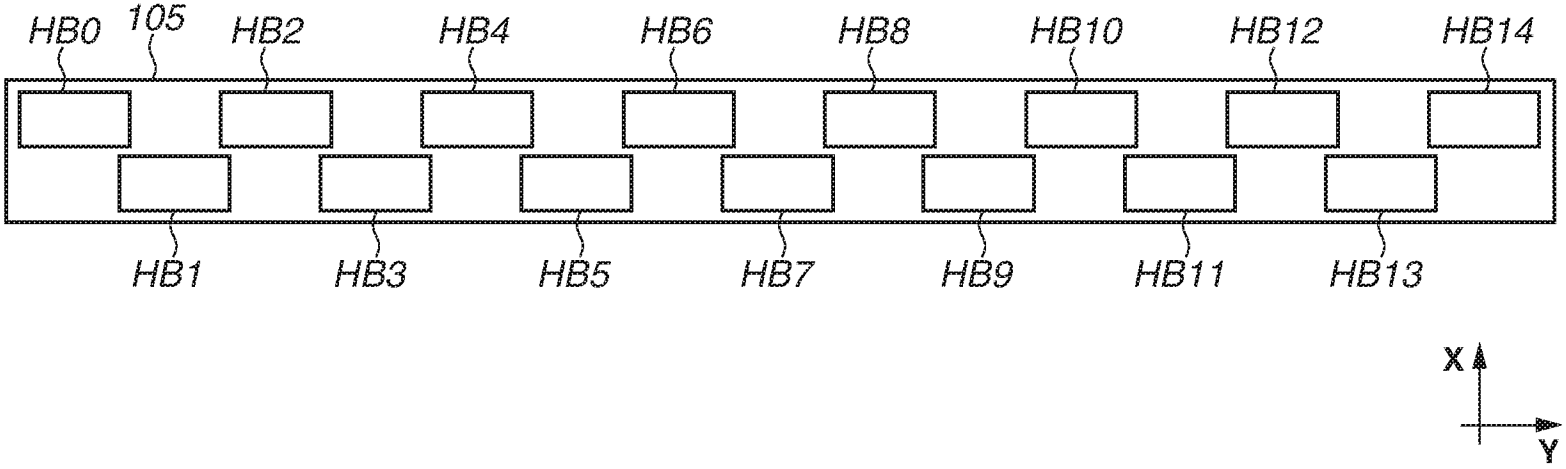
FIG. 2 illustrates a recording head according to an exemplary embodiment.

FIG. 2 illustrates the structure of the recording head 105 for cyan ink which is used in the present exemplary embodiment. To simplify descriptions, only the recording head 105 among the recording heads 105 to 108 will be described below. The recording heads 106 to 108 other than the recording head 105 have a similar structure to that of the recording head 105.

As illustrated in FIG. 2, the recording head 105 in the present exemplary embodiment includes 15 heater boards (recording element substrates) HB0 to HB14. The heater boards HB0 to HB14 are aligned along a Y-direction such that end portions of the heater boards HB0 to HB14 in the Y-direction partially overlap. Use of the recording head 105 including the 15 heater boards HB0 to HB14 aligned in the Y-direction as described above enables recording across a recording medium having a longer width in the Y-direction, as in the case of using a single long recording head.

Figure 3A:
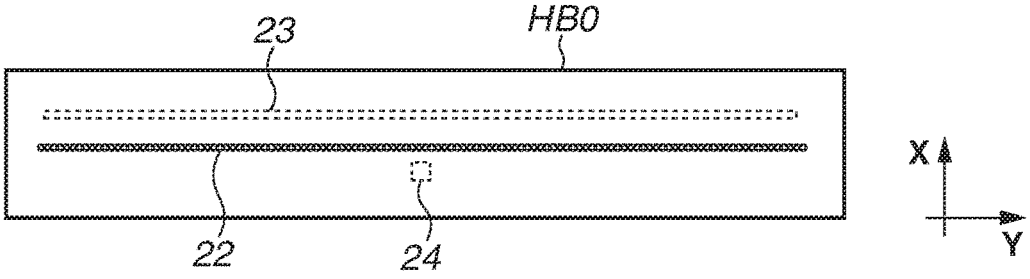
FIGS. 3A, 3B, and 3C illustrate a heater board according to an exemplary embodiment.

FIG. 3A illustrates the structure of the heater board HB0 among the heater boards HB0 to HB14. While only the heater board HB0 will be described below, the other heater boards HB1 to HB14 have a similar structure to that of the heater board HB0.

As apparent from FIG. 3A, the heater board HB0 includes a discharge port array 22, a sub-heater (heating element) 23, and a temperature sensor (detection element) 24.

In the discharge port array 22, a plurality of discharge ports for discharging the cyan ink is aligned in the Y-direction. In each discharge port of the discharge port array 22 is disposed a recording element (not illustrated). The recording elements are used to perform a discharge operation in which a driving pulse is applied to each of the recording elements to drive the recording elements so that the recording elements generate heat energy to cause the ink to foam and discharge the ink from the discharge ports. Hereinafter, a row of the recording elements in the respective discharge ports of the discharge port array 22 is also referred to as a recording element array.

Further, the sub-heater 23 is a member which heats the ink in the vicinities of the recording elements in the heater board HB0 to an extent that the ink is not discharged. Further, the temperature sensor 24 is a member which detects the temperature near the recording elements in the heater board HB0. In the present exemplary embodiment, the sub-heater 23 is driven with different driving intensities based on the temperature detected by the temperature sensor 24 during and before recording to adjust the ink temperature to a desired temperature. Details thereof will be described below.

While the heater board HB0 including therein one sub-heater 23 and one temperature sensor 24 is described above, the heater board HB0 can include therein a plurality of sub-heaters 23 and a plurality of temperature sensors 24.

Figure 3B:
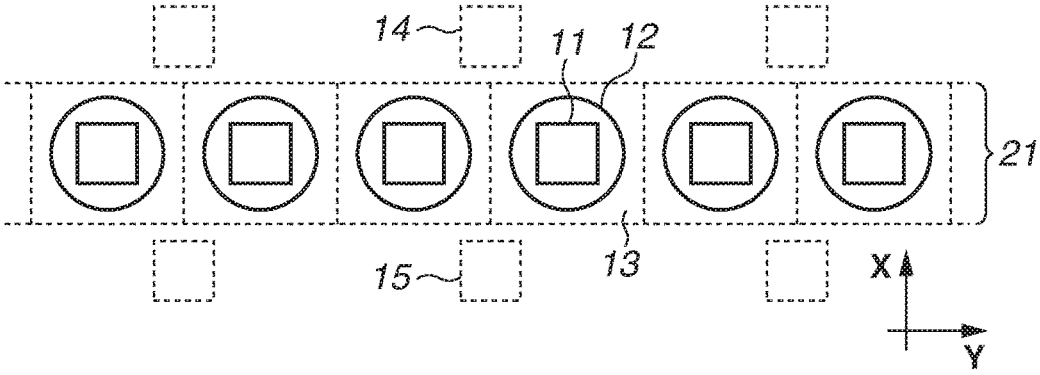

FIG. 3B is an enlarged view illustrating the side on which some of the discharge ports of the discharge port array 22 of the heater board HB0 are formed.

As illustrated in FIG. 3B, recording elements 11 are disposed in positions corresponding to discharge ports 12 of the discharge port array 22. The recording elements are used to perform a discharge operation in which a driving pulse is applied to the recording elements 11 to drive the recording elements 11 so that the recording elements 11 generate heat energy to cause the ink to foam and discharge the ink from the discharge ports 12. The recording elements 11 are respectively disposed in pressure chambers 13 divided by partition walls. Further, an ink supply opening 14 is formed in the positive X-direction of the discharge port array 22, and an ink collection opening 15 is formed in a negative X-direction. Specifically, as illustrated in FIG. 3B, one ink supply opening 14 and one ink collection opening 15 are formed for every two discharge ports 12.

Figure 3C:
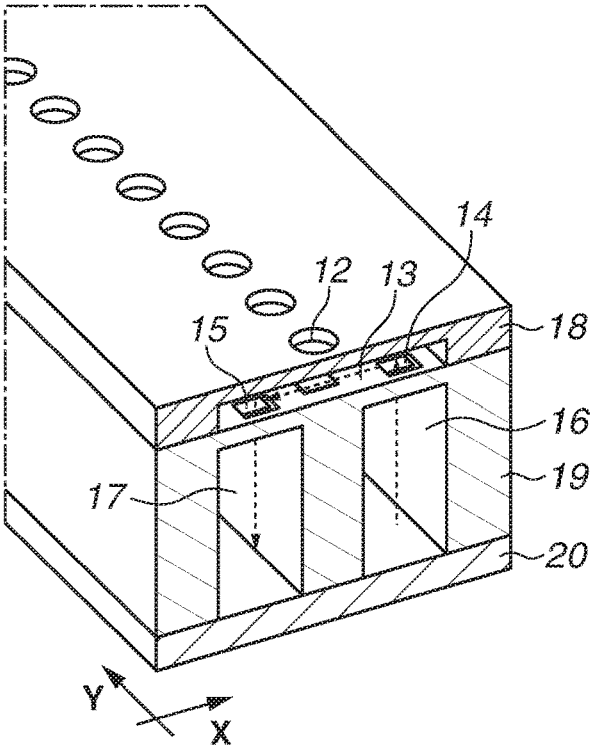

FIG. 3C is a cross-sectional view illustrating a region in the heater board HB0 illustrated in FIG. 3B which is cut along a direction intersecting with an X-Y plane.

As illustrated in FIG. 3C, the heater board HB0 includes three layers. Specifically, a discharge port forming member 18 made of a photosensitive resin is formed on a substrate 19 made of silicon (Si), and to the back side of the substrate 19 is joined a support member 20.

In the front side of the discharge port forming member 18 are formed the discharge ports 12. Further, in the discharge port forming member 18 are formed the pressure chambers 13 in communication with the discharge ports 12.

On the front side (side closer to the discharge port forming member 18) of the substrate 19 are disposed the recording elements 11 described above, and a common ink supply path 16 and a common ink collection path 17 are formed in the substrate 19. Further, the ink supply openings 14 are formed to connect the common ink supply path 16 with the pressure chambers 13 in the discharge port forming member 18, and the ink collection openings 15 are formed to connect the common ink collection path 17 with the pressure chambers 13 in the discharge port forming member 18.

The common ink supply path 16 and the common ink collection path 17 are formed over the range in the Y-direction in which the discharge ports 12 are aligned. Further, control is performed to generate a negative pressure difference between the common ink supply path 16 and the common ink collection path 17 as described below. Thus, while the ink is discharged from some of the discharge ports 12 by a recording operation, the negative pressure difference causes the ink in the common ink supply path 16 to flow through the ink supply openings 14, the pressure chambers 13, and the ink collection openings 15 and then into the common ink collection path 17 (a dotted arrow in FIG. 3C) in the discharge ports 12 from which no ink is discharged. By this flow, thickened ink, foam, foreign matter, etc. in the discharge ports 12 and the pressure chambers 13 that are produced by evaporation from the discharge ports 12 are collected into the common ink collection path 17.

Further, the support member 20 functions as a cover which constitutes a part of walls of the common ink supply path 16 and the common ink collection path 17 in the substrate 19.

(Structure of Circulation Channels)

Figure 4:
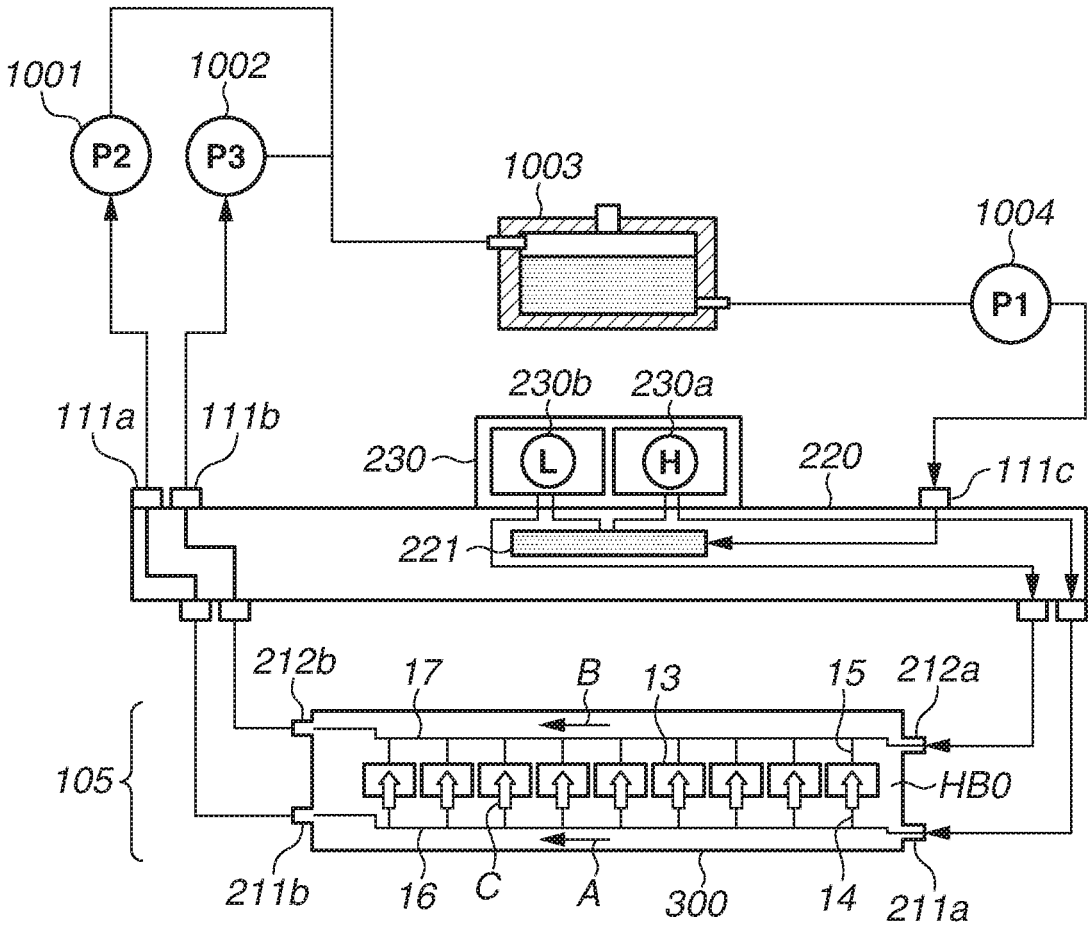
FIG. 4 illustrates a circulation structure according to an exemplary embodiment.

FIG. 4 schematically illustrates the structure of circulation channels applied to the present exemplary embodiment. To simplify descriptions, only the circulation channel in the recording head 105 among the recording heads 105 to 108 will be described below. The circulation channels in the other recording heads 105 to 108 are similar to that in the recording head 105. In the present exemplary embodiment, the ink is supplied from a main tank 1003 through a third circulation pump 1004, circulated through a negative pressure control unit 230 and the recording head 105, and collected into the main tank 1003 through a first circulation pump 1001 and a second circulation pump 1002. This supply/collection channel will be referred to as "circulation channel".

The recording head 105 is fluidically connected with the first circulation pump (P2) 1001 on the high-pressure side, the second circulation pump (P3) 1002 on the low-pressure side, and the main tank (ink tank) 1003 which stores the ink. The main tank 1003 is capable of ejecting foam contained in the ink to the outside thereof through an air communication port (not illustrated) which communicates the inside and the outside of the main tank 1003 with each other. The ink in the main tank 1003 is consumed through image recording/recovery processing (including preliminary discharge, suction ejection, and pressure ejection), and when the main tank 1003 becomes empty, the main tank 1003 is removed from the recording apparatus and replaced.

As described above, each of the plurality of heater boards HB0 to HB14 in the recording head 105 includes the common ink supply path 16 and the common ink collection path 17, and the plurality of pressure chambers 13 are formed between the common ink supply path 16 and the common ink collection path 17 to be in communication with the common ink supply path 16 and the common ink collection path 17 through the ink supply opening 14 and the ink collection opening 15. While FIG. 4 illustrates only the heater board HB0 among the heater boards HB0 to HB14 to simplify descriptions, the heater boards HB0 to HB14 are connected in series. The heater board HB0 is located on the most upstream side (right-hand side in FIG. 4) in an ink circulation direction and the heater board HB14 on the most downstream side (left-hand side in FIG. 4), and the heater boards HB0 to HB14 with greater numbers are located in more downstream positions.

The first circulation pump 1001 pumps the ink contained in the common ink supply path 16 and returns the ink to the main tank 1003 through a connection portion 111*a* of the negative pressure control unit 230 and an outlet 211*b* of the recording head 105. The second circulation pump 1002 pumps the ink contained in the common ink collection path 17 and returns the ink to the main tank 1003 through a connection portion 111*b* of the negative pressure control unit 230 and an outlet 212*b* of the recording head 105. The first circulation pump 1001 and the second circulation pump 1002 are desirably positive displacement pumps capable of transferring liquid quantitatively. Specific examples include tube pumps, gear pumps, diaphragm pumps, and syringe pumps. Alternatively, a commonly-used constant-flow valve or relief valve can be provided at an outlet of a pump to ensure a constant flow.

While the recording head 105 is driven, the first circulation pump 1001 and the second circulation pump 1002 respectively pass a constant amount of ink to the common ink supply path 16 and the common ink collection path 17 in the direction of an arrow A (supply direction) and the direction of an arrow B (collection direction) in FIG. 4. The flow rate is an amount by which a difference in temperature among the heater boards HB0 to HB14 is reduced to an extent that the image quality of recorded images is not affected. However, if the flow rate becomes excessively high, the difference in negative pressure among the heater boards HB0 to HB14 can become excessively large due to an effect of pressure loss in a flow path in the recording head 105 to cause non-uniform concentrations of recorded images. Thus, the ink flow rates of in the common ink supply path 16 and the common ink collection path 17 are desirably set with consideration for the differences in temperature and negative pressure among the heater boards HB0 to HB14.

The negative pressure control unit 230 is disposed on the flow path between the third circulation pump (P1) 1004 and the recording head 105. The negative pressure control unit 230 has the function of maintaining the pressure of the ink on the recording head 105 side constant even when the ink flow rate in the ink circulation system is changed according to the concentration (discharge amount) of an image to be recorded. The negative pressure control unit 230 includes two pressure adjustment mechanisms 230*a* and 230*b*, and any mechanisms capable of controlling the pressure in the flow path located on the downstream side of the pressure adjustment mechanisms 230*a* and 230*b* within a predetermined range with a desired set pressure being the center can be used. For example, a mechanism similar to a vacuum regulator can be employed. In the case of using a vacuum regulator, desirably a pressure is applied to the inside of the flow path located on the upstream side of the negative pressure control unit 230 by the third circulation pump 1004 through an ink supply unit 220 as illustrated in FIG. 4. In this way, the effect of the hydraulic head pressure between the main tank 1003 and the recording head 105 on the recording head 105 is suppressed to increase the degree of freedom of the layout of the main tank 1003 in the recording apparatus. The third circulation pump 1004 is connected with the pressure adjustment mechanisms 230*a* and 230*b* through the connection portion 111*b* of the negative pressure control unit 230 and a filter 221. The third circulation pump 1004 can be any pump having a predetermined pump head pressure or higher in the range of the ink circulation flow rates when the recording head 105 is driven, and a turbo pump, positive displacement pump, etc. can be used as the third circulation pump 1004. For example, a diaphragm pump or the like is applicable. Further, a hydraulic head tank disposed with a predetermined hydraulic head difference with respect to the negative pressure control unit 230 is applicable in place of the third circulation pump 1004.

Respectively different control pressures are set to the two pressure adjustment mechanisms 230*a* and 230*b* of the negative pressure control unit 230. The pressure adjustment mechanism 230*a* which is set to a relatively high pressure is denoted by "H" in FIG. 4, and the pressure adjustment mechanism 230*b* which is set to a relatively low pressure is denoted by "L" in FIG. 4. The pressure adjustment mechanism 230*a* is connected with an inlet 211*a* of the common ink supply path 16 in the recording head 105 through the ink supply unit 220. The pressure adjustment mechanism 230*b* is connected with an inlet 212*a* of the common ink collection path 17 in the recording head 105 through the ink supply unit 220.

The inlet 211*a* of the common ink supply path 16 is connected with the high-pressure-side pressure adjustment mechanism 230*a*, and the inlet 212*a* of the common ink collection path 17 is coupled with the low-pressure-side pressure adjustment mechanism 230*b*, so that a negative pressure difference occurs between the common ink supply path 16 and the common ink collection path 17. Thus, some of the ink flowing in the directions of the arrows A and B in the common ink supply path 16 and the common ink collection path 17 flows in the direction of an arrow C through the ink supply openings 14, the pressure chambers 13, and the ink collection openings 15.

As described above, the ink flows in the directions of the arrows A and B in the common ink supply paths 16 and the common ink collection paths 17 in the heater boards HB0 to HB14 in the recording head 105. Thus, heat generated in the heater boards HB0 to HB14 is ejected outside by the flow of the ink in the common ink supply path 16 and the common ink collection path 17. Further, the above-described structure makes it possible to prevent the ink from thickening in the discharge ports 12 and the pressure chambers 13 by causing the ink to flow also in the direction of the arrow C in the discharge ports 12 and the pressure chambers 13 from which no ink is discharged during the recording operation.

(Recording Control System)

Figure 5:
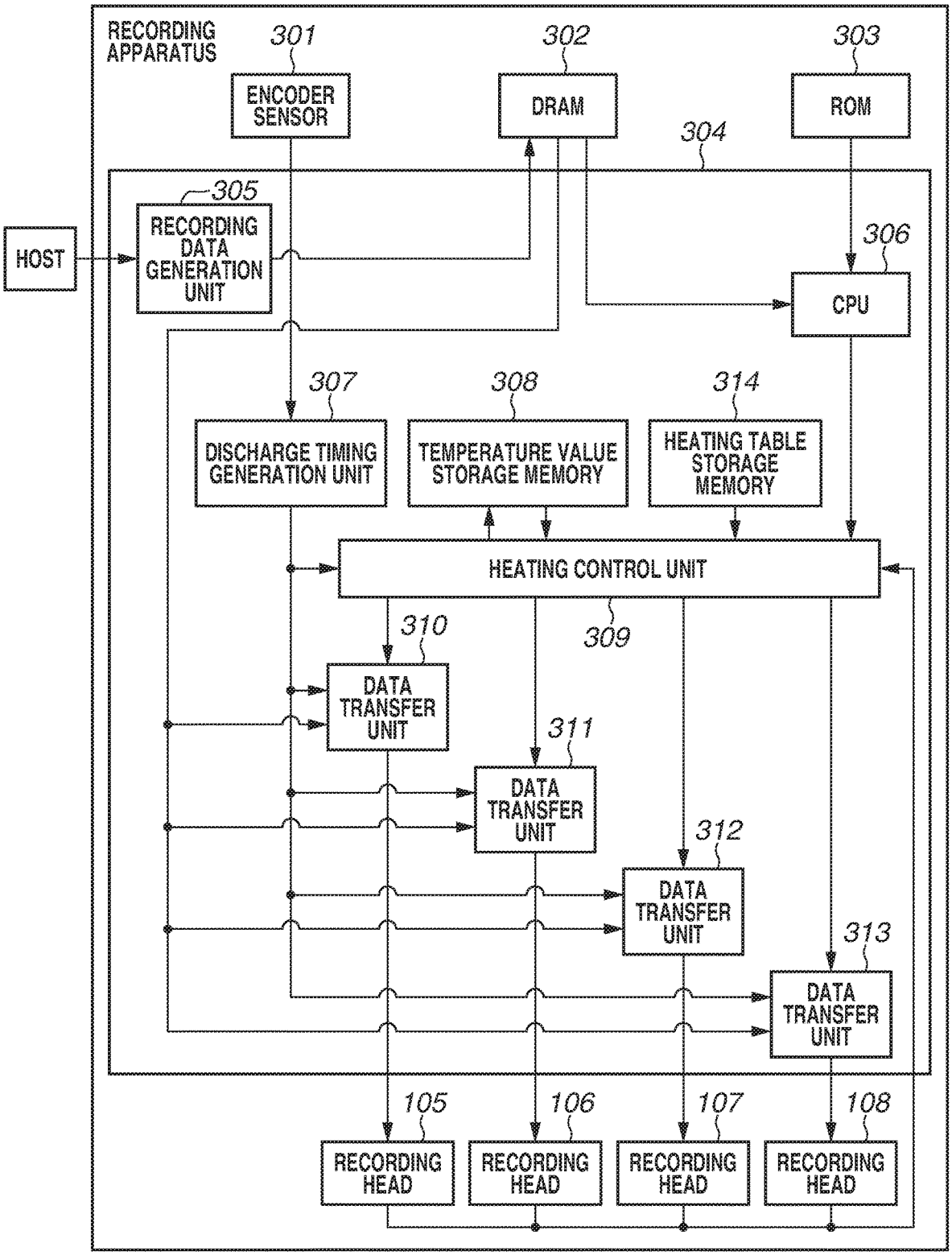
FIG. 5 illustrates a recording control system according to an exemplary embodiment.

FIG. 5 illustrates the structure of a recording control system in the recording apparatus according to the present exemplary embodiment. To simplify descriptions, only the recording control system in the recording head 105 among the recording heads 105 to 108 will be described below.

As illustrated in FIG. 5, the recording apparatus includes an encoder sensor 301, a dynamic random-access memory (DRAM) 302, a read-only memory (ROM) 303, a controller (e.g., an application specific integrated circuit (ASIC)) 304, and the recording heads 105 to 108.

Then, the controller 304 includes a recording data generation unit 305, a central processing unit (CPU) 306, a discharge timing generation unit 307, a temperature value storage memory 308, a heating table storage memory 314, and data transfer units 310 to 313.

The CPU 306 reads a program stored in the ROM 303 and executes the program to control entire operations of the recording apparatus, e.g., an operation of driving drivers such as motors. Further, the ROM 303 stores fixed data necessary for various operations of the recording apparatus as well as various control programs to be executed by the CPU 306. For example, the ROM 303 stores a program for executing recording control in the recording apparatus.

The DRAM 302 is needed for the CPU 306 to execute a program. The DRAM 302 is used as a work area of the CPU 306 or as a temporary storage area for various types of received data and stores various types of setting data. While only one DRAM 302 is illustrated in FIG. 5, a plurality of DRAMs can be mounted, or both a DRAM and a static random-access memory (SRAM) can be mounted to include a plurality of memories of different access speeds.

The recording data generation unit 305 receives image data from a host (personal computer (PC)) outside the recording apparatus. The recording data generation unit 305 performs color conversion processing, quantization processing, etc. on the image data to generate recording data for use in discharging ink from the recording heads 105 to 108 and stores the recording data in the DRAM 302.

The discharge timing generation unit 307 receives position information indicating the relative positions of the respective recording heads 105 to 108 and the recording medium P which are detected by the encoder sensor 301. The discharge timing generation unit 307 generates discharge timing information indicating timings of discharges from the respective recording heads 105 to 108 based on the position information. Details of the generation of the discharge timing information will be described below.

The four data transfer units 310 to 313 read the recording data stored in the DRAM 302 in synchronization with the discharge timings generated by the discharge timing generation unit 307. Further, the data transfer units 310 to 313 generate heating information defining heating conditions of the respective heater boards HB0 to HB14 based on the temperature information about the respective heater boards HB0 to HB14 of the recording heads 105 to 108 which is stored in the temperature value storage memory 308 and a table stored in the heating table storage memory 314. Then, the data transfer units 310 to 313 transfer the recording data and the heating information to the respectively corresponding recording heads 105 to 108.

Then, while performing various heating operations based on the heating information, the recording heads 105 to 108 drive the recording elements based on the recording data to discharge the ink. At this time, temperatures detected by the temperature sensors 24 of the heater boards HB0 to HB14 in the recording heads 105 to 108 are output to a heating control unit 309 in the recording apparatus. Then, the heating control unit 309 stores temperature information about the newly-detected temperatures in the temperature value storage memory 308 and updates the temperature information. The updated temperature information is used at the next heating information generation timing.

(Estimation of Ink Concentration in Circulation Channel)

In the case of using a recording apparatus including circulation channels as illustrated in FIGS. 3A to 4, even if the ink is concentrated (even if the concentrations increase) in the vicinities of the discharge ports, the circulation of the ink causes the concentrated ink to be removed from the vicinities of the discharge ports through the circulation channels. This prevents further concentration only in the vicinities of the discharge ports; however, concentration is gradually developed in the entire circulation channels due to the circulation. This can change the discharge speeds to cause deviations of ink landing positions.

Thus, in the present exemplary embodiment, the ink concentrations in the circulation channels are estimated, and a correction value for use to correct deviations of ink landing positions is determined based on the estimated ink concentrations. In the present exemplary embodiment, information about the amounts of ink evaporation in the circulation channels, information about the amounts of ink consumption in the circulation channels, and information about the initial amounts of ink in the circulation channels are acquired (evaporation amount acquisition, consumption amount acquisition, initial amount acquisition), and the ink concentrations in the circulation channels are acquired (concentration acquisition) based on the acquired information.

The following processing is performed for each ink color. To simplify descriptions, only the processing for one ink color will be described below.

1. Ink Evaporation Amount in Circulation Channel

In the present exemplary embodiment, first, an evaporation amount Vx during recording operation and an evaporation amount Vy during a non-recording operation are calculated and then added up to obtain a total evaporation amount V (Vx+Vy). In the present exemplary embodiment, the processing of calculating the evaporation amounts Vx and Vy is performed to calculate the evaporation amount V before and after the processing of updating the ink concentrations in the circulation channels (N(x)→N(x+1)), which will be described below.

First, a non-discharge ratio Hx, an evaporation rate Zx, and a recording time Tx are calculated for each ink color to calculate the evaporation amounts Vx during recording operation with respect to the respective ink colors.

Figure 6:
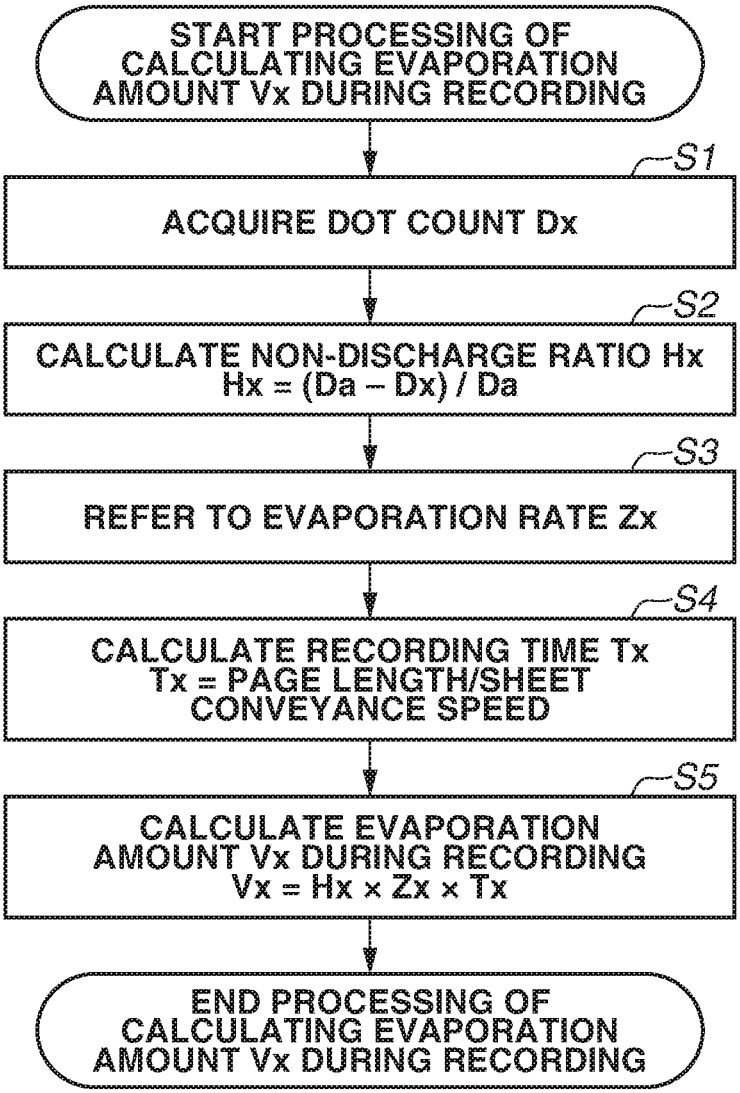
FIG. 6 is a flowchart illustrating a method for calculating an evaporation amount during recording according to an exemplary embodiment.

FIG. 6 is a flowchart illustrating a process of calculating the evaporation amount Vx during recording operation which is executed by a control program in the present exemplary embodiment.

If recording start information is received, the process of calculating the evaporation amount Vx during recording is started. First, in step S1, a count (dot count) of the number of discharges of the inks of the respective colors in a page is performed based on the recording data for use in recording to calculate an ink dot count Dx.

Then, in step S2, the non-discharge ratio Hx is calculated for each ink color. The non-discharge ratio Hx corresponds to the ratio of pixels not discharging ink with respect to pixels capable of discharging ink. Specifically, a case in which each color is fully discharged is set as 1, and a value obtained by subtracting the dot count Dx from a dot count Da in the case of the full discharge and dividing the obtained value by the dot count Da in the case of the full discharge is determined as the non-discharge ratio Hx. In the present exemplary embodiment, the non-discharge ratio Hx is calculated for each ink color.

Next, in step S3, processing is performed to refer to the ink evaporation rate Zx. The evaporation amount per second is measured in advance, and the measured evaporation amount is stored as the evaporation rate Zx in the heating table storage memory 314. The values of the evaporation rate Zx are higher at higher temperatures because evaporation is more likely to occur at higher temperatures. Table 1 shows details of the evaporation rate Zx in the present exemplary embodiment. In the case in which the heater board temperature is lower than 25 degrees Celsius, the evaporation rate is expressed by Zx=μg/sec. In the case in which the heater board temperature is 25 degrees Celsius or higher and lower than 40 degrees Celsius, the evaporation rate is expressed by Zx=150 μg/sec. In the case in which the heater board temperature is 40 degrees Celsius or higher, the evaporation rate is expressed by Zx=420 μg/sec.

TABLE 1

| Evaporation Rate | Temperature Control Temperature [Degrees in Celsius] | | |
|---|---|---|---|
| [μg/sec] | Lower Than 25 | Lower Than 40 | 40 or Higher |
| Zx | 40 | 150 | 420 |

Next, in step S4, the recording time Tx necessary for recording one page is calculated. Specifically, the recording time Tx is calculated by dividing the length of one page by the sheet conveyance speed.

Then, in step S5, the evaporation amount Vx during recording operation is calculated. Specifically, the non-discharge ratio Hx, the evaporation rate Zx, and the recording time Tx are multiplied together to calculate an evaporation amount in one page. Then, similar processing is performed on each page to calculate the evaporation amount Vx during recording operation.

Next, an evaporation rate Zy and an elapsed time Ty of the non-recording operation are calculated to calculate for each ink color the evaporation amount Vy during the non-recording operation.

Figure 7:
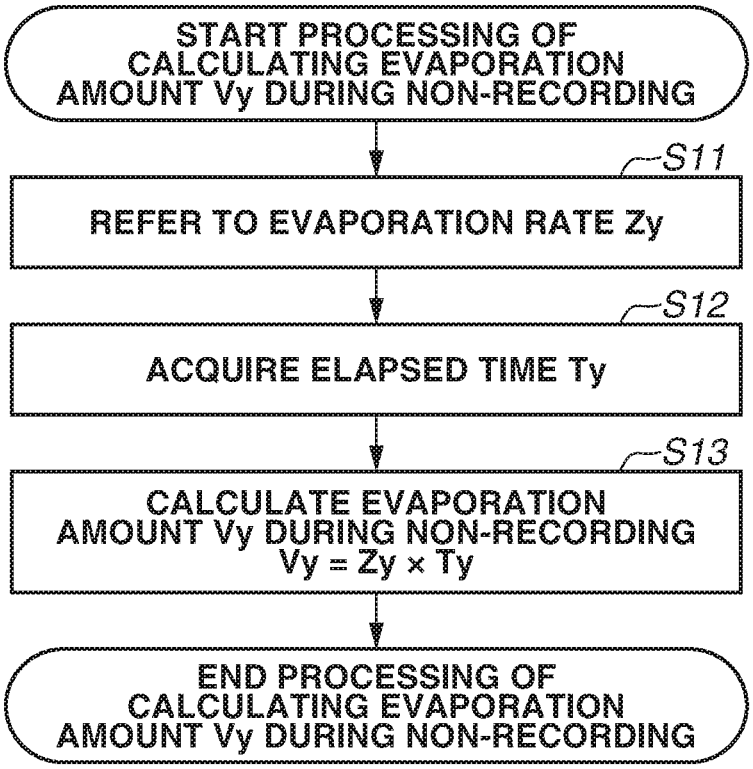
FIG. 7 is a flowchart illustrating a method for calculating an evaporation amount during non-recording according to an exemplary embodiment.

FIG. 7 is a flowchart illustrating a process of calculating the evaporation amount Vy during non-recording operation which is executed by a control program in the present exemplary embodiment.

If the process of calculating the evaporation amount Vy during non-recording is started, then in step S11, processing is performed to refer to the evaporation rate Zy of each ink color. The evaporation rate Zy during non-recording per minute is measured in advance, and the measured evaporation amount is stored in the heating table storage memory 314. Further, the values of the evaporation rate Zy are higher at higher temperatures because evaporation is more likely to occur at higher temperatures.

During non-recording operation, the discharge ports 12 of the recording heads 105 to 108 are covered with a cap member, so that the evaporation rate per elapsed time is lower than that during recording operation. Table 2 shows details of the evaporation rate Zy in the present exemplary embodiment. In the case in which the heater board temperature is lower than 15 degrees Celsius, the evaporation rate is expressed by Zy=1 μg/min. In the case in which the heater board temperature is 15 degrees Celsius or higher and lower than 25 degrees Celsius, the evaporation rate is expressed by Zy=2 μg/min. In the case in which the heater board temperature is 25 degrees Celsius or higher, the evaporation rate is expressed by Zy=5 μg/min.

TABLE 2

| Evaporation Rate | Ambient Temperature [Degrees Celsius] | | |
|---|---|---|---|
| [μg/min] | Lower Than 15 | Lower Than 25 | 25 or Higher |
| Zy | 1 | 2 | 5 |

Next, in step S12, the elapsed time Ty during non-recording operation is calculated.

Then, in step 13, the evaporation amount Vy during the non-recording operation is calculated. Specifically, the evaporation rate Zy and the elapsed time Ty are multiplied to calculate the evaporation amount Vy during non-recording operation, and the process is ended.

The evaporation amount Vx during recording operation and the evaporation amount Vy during non-recording operation which are calculated as described above are added to calculate the total evaporation amount V.

2. Ink Consumption Amount in Circulation Channel

Next, an ink consumption amount In during recording operation and during non-recording operation is calculated.

Figure 8:
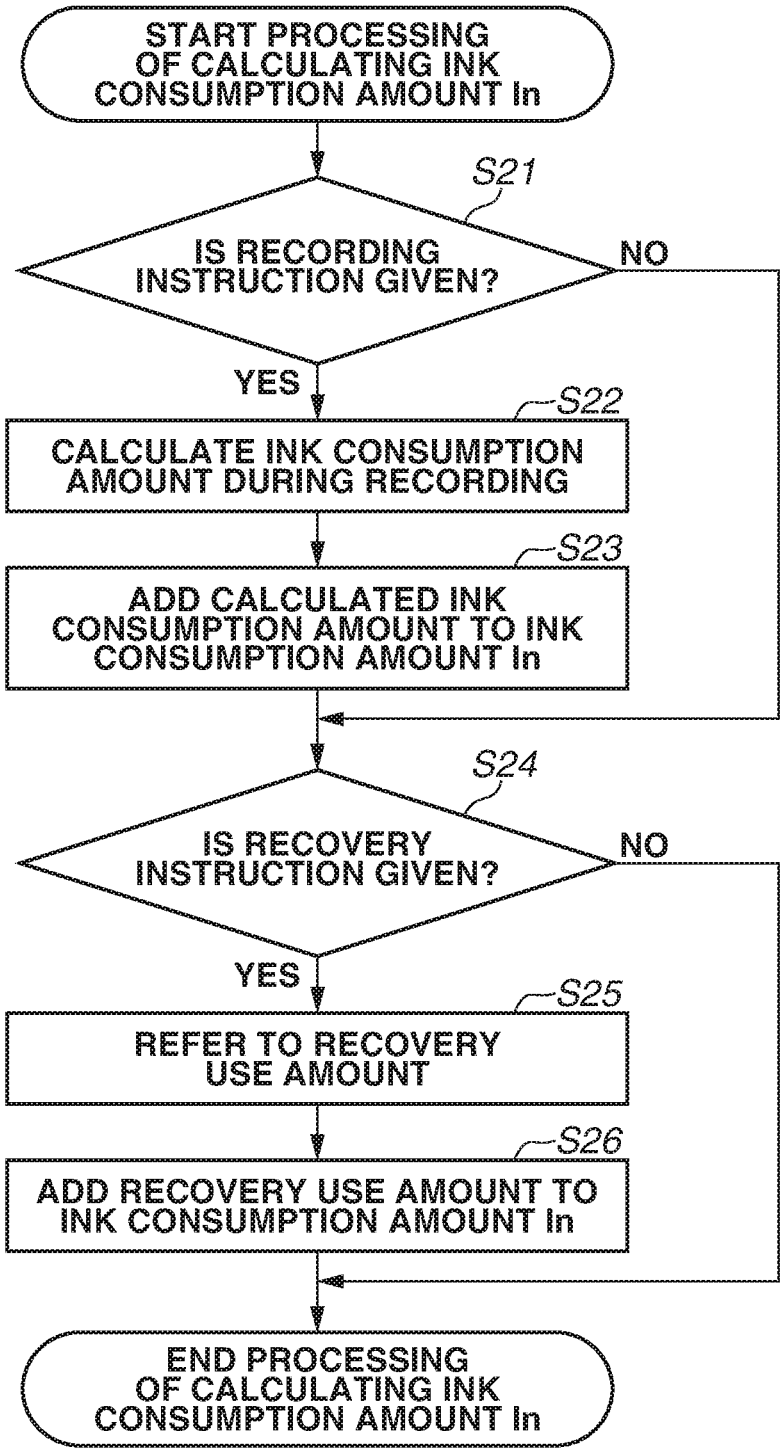
FIG. 8 is a flowchart illustrating a method for calculating an ink consumption amount according to an exemplary embodiment.

FIG. 8 is a flowchart illustrating a process of calculating the ink consumption amount In which is executed by the control program in the present exemplary embodiment.

If the process of calculating the ink consumption amount is started, then in step S21, whether a recording instruction is given is determined. If no recording instruction is given (NO in step S21), the processing proceeds to step S24 described below. On the other hand, if a recording instruction is given (YES in step S21), the processing proceeds to step S22. In step S22, processing is performed to refer to an ink consumption amount which is acquired from a dot count, etc. and used during recording, and the ink consumption amount during recording is calculated. In step S23, after the calculation, the calculated consumption amount is added to the ink consumption amount In.

Then, in step S24, whether a recovery instruction is given is determined. If no recovery instruction is given (NO in step S24), the process of calculating the ink consumption amount In is ended. On the other hand, if a recovery instruction is given (YES in step S24), the processing proceeds to step S25. In step S25, processing is performed to refer to a recovery use amount stored in advance in the memory. Then in step S26, the recovery use amount is added to the ink consumption amount In. Thereafter, the process of calculating the ink consumption amount In is ended.

As described above, in the present exemplary embodiment, each time a recording instruction or a recovery instruction is given, the ink consumption amount or the recovery use amount is added to the ink consumption amount In to manage the ink consumption amount in the circulation channels.

3. Ink Concentration in Circulation Channel

In the present exemplary embodiment, the ink concentration in the circulation channels is calculated using the evaporation amount V and the ink consumption amount In which are calculated as described above.

Figure 9:
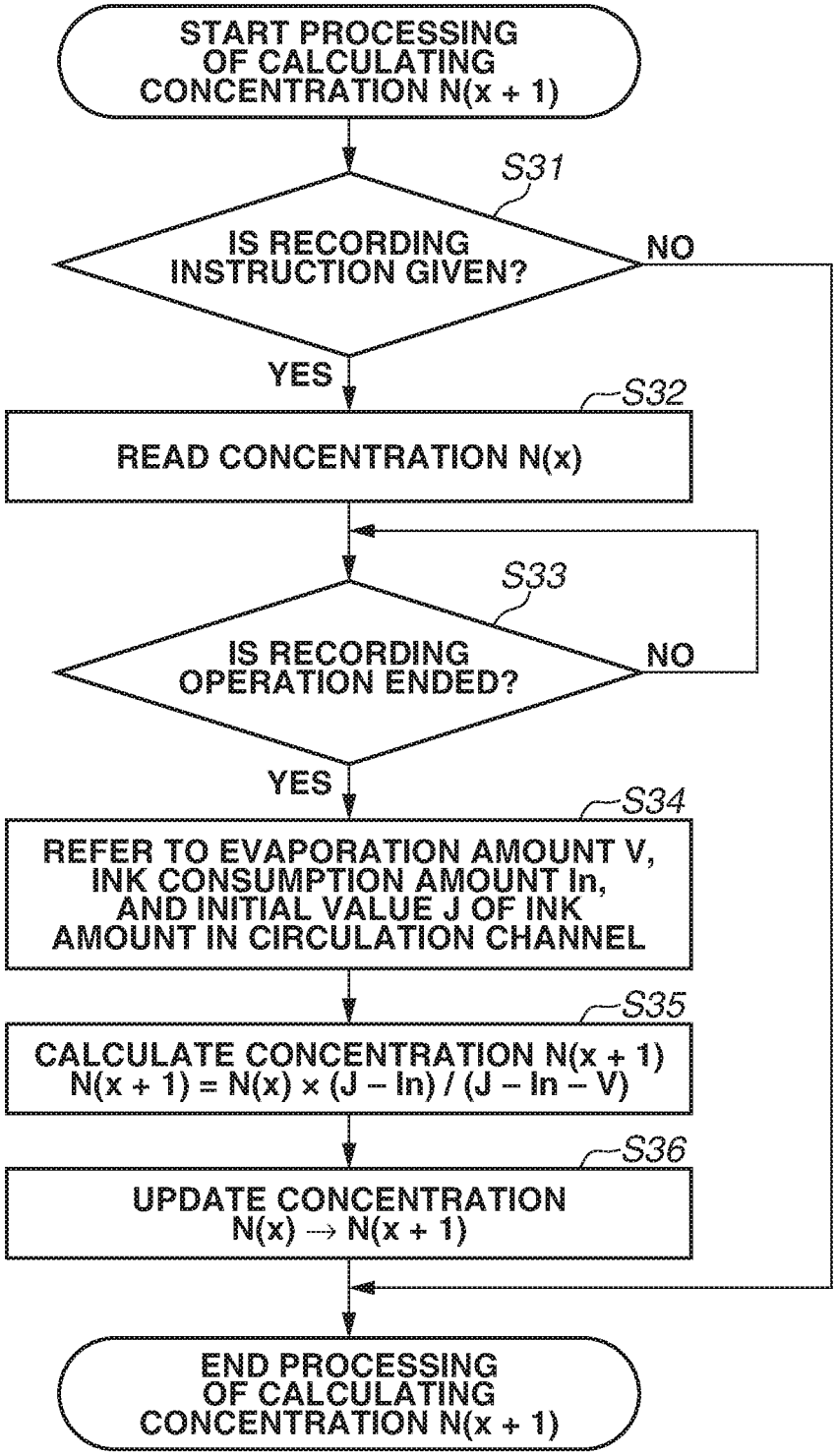
FIG. 9 is a flowchart illustrating a method for calculating a concentration according to an exemplary embodiment.

FIG. 9 is a flowchart illustrating a process of calculating the ink concentration in the circulation channels which is executed by the control program in the present exemplary embodiment.

If the process of calculating the concentration is started, then in step S31, whether a recording instruction is given is determined. If no recording instruction is given (NO in step S31), the process is ended. On the other hand, if a recording instruction is given (YES in step S31), the processing proceeds to step S32. In step S32, a concentration N(x) which is already calculated in the previous concentration calculation processing is read. The initial values Nref of the concentrations of the inks used in the present exemplary embodiment are as shown in Table 3.

TABLE 3

| Color | Bk | Cy | Ma | Ye |
|---|---|---|---|---|
| Nref | 0.08 | 0.06 | 0.06 | 0.06 |

Next, in step S33, whether the recording operation is ended is determined. If the recording operation is not ended (NO in step S33), the processing returns, and the determination of whether the recording operation is ended is repeated until the recording operation is ended. On the other hand, if the recording operation is ended (YES in step S33), the processing proceeds to step S34. In step S34, processing is performed to refer to the evaporation amount V, the ink consumption amount In during recording operation, and the ink consumption amount In during recovery operation which are calculated as described above, and the initial values J of the ink amounts in the circulation channels. The initial values J of the ink amounts in the circulation channels are values determined in advance according to the shape of the circulation channels, ink, etc. In the present exemplary embodiment, the initial values J of the ink amounts in the circulation channel are as shown in Table 4.

TABLE 4

| Color | Bk | Cy | Ma | Ye |
|---|---|---|---|---|
| J[g] | 194 | 188 | 185 | 183 |

Then, in step S35, the concentrations N(x+1) after recording/recovery operation are calculated based on the evaporation amounts V before and after recording/recovery operation, the ink consumption amounts In during recording/recovery operation, the initial values J of the ink amounts in the circulation channels, and the concentrations N(x) before recording/recovery operation. The evaporation amount V and the ink consumption amount In each correspond to the amount from the time of calculation of the concentration N(x) before recording/recovery operation to the time of calculation of the concentration N (x+1) after recording/recovery operation.

A method for deriving the concentration N (x+1) will be described below. In the following description, the ink amount in the circulation channels before recording/recovery operation is denoted by J(x).

The amount of pigment existing in the circulation channels prior to recording/recovery operation is expressed as N(x)×J(x), where N(x) denotes the concentration and J(x) denotes the ink amount.

Further, after recording/recovery operation, the ink is lost by an amount In through recording/recovery operation and by an amount V through evaporation, compared to the ink before recording/recovery operation, so that the ink amount is expressed as J(x)−In−V. Further, the concentration after recording/recovery operation is expressed as N (x+1), so that the amount of pigment existing in the circulation channels after recording/recovery operation is expressed as N (x+1)×(J(x)−In −V).

Further, the pigment is also contained in the ink discharged during recording/recovery operation. This amount is expressed as N(x)×In, as the concentration is N(x) and the ink consumption amount is In.

Since the pigment does not evaporate, the ink amount V lost through evaporation does not contain the pigment.

Thus, the sum of the amount of pigment existing in the circulation channels after recording/recovery operation and the amount of pigment lost through discharges during recording/recovery operation is equal to the amount of pigment existing in the circulation channels before recording/recovery operation. Accordingly, formula 1 below is derived.

$$N(x+1)\times(J(x)-\mathrm{In}-V)+N(x)\times\mathrm{In}=N(x)\times J(x) \qquad \text{formula 1}$$

From formula 1, the following formula 2 for calculating the concentration N (x+1) in the circulation channels after recording/recovery operation is obtained.

$$N(x+1)=N(x)\times(J(x)-\mathrm{In})/(J(x)-\mathrm{In}-V) \qquad \text{formula 2}$$

The value of J(x) is significantly larger than the values of In and V, so that the item J(x) can be approximated to the initial value J of the ink amount. Accordingly, formula 3 below is derived.

$$N(x+1)=N(x)\times(J-\mathrm{In})/(J-\mathrm{In}-V) \qquad \text{formula 3}$$

In the present exemplary embodiment, the concentration N (x+1) after recording/recovery operation is calculated based on formula 3 described above.

Thereafter, in step S36, the current concentration N(x) is updated to N (x+1), and the process is ended.

While the concentration N (x+1) is calculated using formula 3 in the present exemplary embodiment, the concentration N (x+1) can also be calculated using formula 2 in which J(x) is not approximated. In this case, although the ink amount J(x) in the circulation channels before recording/recovery operation needs to be calculated separately, since no approximation is involved, the concentration N (x+1) is calculated more accurately.

(Discharge Timing Adjustment)

In the present exemplary embodiment, the ink discharge timings are adjusted based on the ink concentration in the circulation channels which is obtained as described above. In the present exemplary embodiment, even if the concentration of some of the ink is increased, the discharge timings are adjusted such that the inks of the respective colors land in ideal positions, and control is performed to cause the inks of the respective colors to land onto the same positions.

Figure 10A:
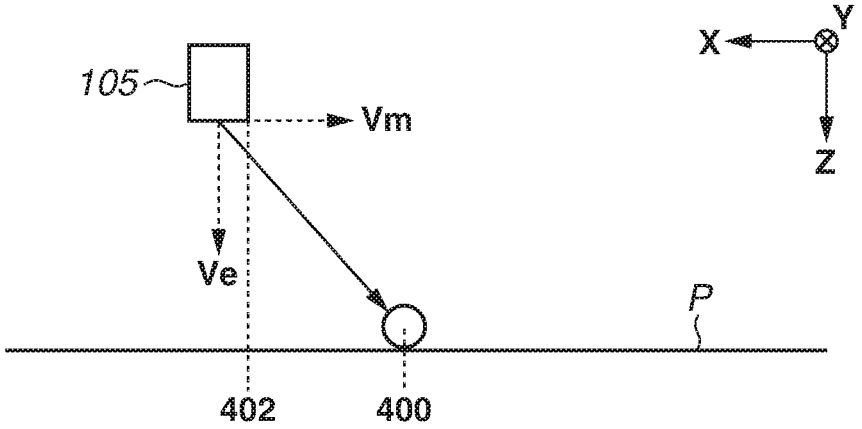
FIGS. 10A, 10B, and 10C illustrate a discharge timing adjustment according to an exemplary embodiment.
Figure 10B:
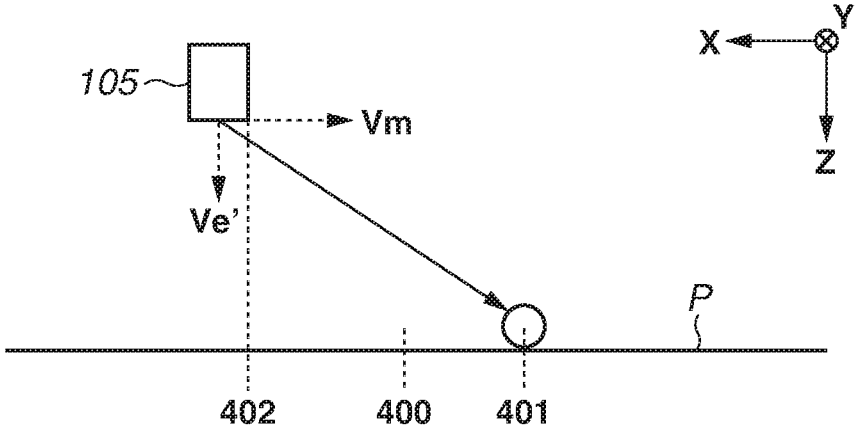
Figure 10C:
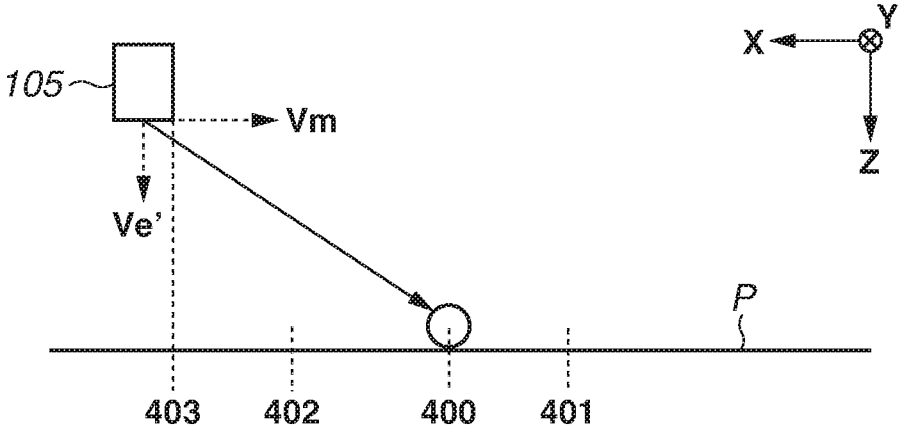

FIGS. 10A to 10C illustrate a deviation of the ink landing position which is caused by the ink concentration in the circulation channels and a correction of a deviation of the landing position by adjusting the discharge timing in the present exemplary embodiment. To simplify descriptions, only a discharge from the recording head 105 is illustrated.

Further, while FIG. 1 illustrates the recording apparatus in which a recording operation is performed while the recording medium P is conveyed in the positive X-direction, a recording operation is performed while the recording head 105 is moved in the negative X-direction in FIGS. 10A to 10C to simplify descriptions. Since the recording head 105 is actually not to be moved, there is no vector of a movement speed Vm of the recording head in the negative X-direction. Instead, there is a vector of the movement speed Vm of the recording medium P in the positive X-direction. In light of the relative relationship between the recording medium P and the recording head 105, the movement of the recording head 105 in the negative X-direction and the conveyance of the recording medium Y in the positive X-direction are substantially the same, so that the recording head is to be moved in the negative X-direction in the following description.

FIG. 10A illustrates how the ink lands when the concentration in the circulation channels is not significantly increased and the ink discharge speed is not decreased. In FIG. 10A, the ink discharge speed is the same as a preset reference speed Ve. Further, the movement speed of the recording head 105 in the minus X-direction (i.e., sheet conveyance speed of the recording medium in the positive X-direction) is the speed Vm.

To cause the ink to land in an ideal position 400 on the recording medium P in the X-direction, the recording head 105 discharges the ink with a positional relationship in that the recording head 105 is located in a position 402 deviated from the ideal position 400 in the positive X-direction. The discharge is performed at a timing before the timing at which the recording head 105 and the ideal position 400 have a positional relationship facing each other. An ink drop discharged from the recording head 105 is discharged in the direction of the vector sum of the discharge speed Ve and the movement speed Vm. The ink discharge timing corresponding to the position 402 is preset such that an ink drop discharged in the direction of such a vector sum lands in the ideal position 400.

FIG. 10B illustrates how the ink lands in a case where the concentration in the circulation channels increases and the ink discharge speed decreases significantly. Thus, the ink discharge speed is a speed Ve' which is slower than the reference speed Ve In this case, if the ink is discharged in the positional relationship in that the recording head 105 is located above the position 402 as in FIG. 10A, the ink lands at a position 401 deviated in the negative X-direction from the ideal position 400 on the recording medium P, not as in FIG. 10A.

The reason is as follows. As a result of the decrease in the ink discharge speed Ve', the direction of the vector sum of the discharge speed Ve' and the movement speed Vm which is the direction in which the ink is discharged is changed. In the case in which the concentration is increased which is illustrated in FIG. 10B, the effect of the movement speed Vm on the discharge speed is relatively larger than that in the case in which the concentration is not increased as in FIG. 10A, so that the ink lands at the position 401 deviated in the negative X-direction.

FIG. 10C illustrates how the ink lands when the ink discharge timing is corrected according to the present exemplary embodiment in the case in which the concentration in the circulation channels is increased.

In the present exemplary embodiment, when the concentration in the circulation channels is increased, the ink discharge timing is adjusted to be earlier than that in the case in which the concentration is not increased. Details thereof will be described below.

In the present exemplary embodiment, in the case in which the concentration in the circulation channels is increased, the ink is discharged at an earlier timing than the timing at which the ink is discharged in the case in which the concentration is not increased (timing at which the recording head 105 corresponds to the position 402 on the recording medium P). Specifically, as illustrated in FIG. 10C, the ink discharge timing is changed to an earlier timing to discharge the ink onto a position 403 deviated from the position 402 in the positive X-direction. The position 403 is such a position that an ink drop lands in the ideal position 400 in the case in which the ink is discharged in the direction of the vector sum of the discharge speed Ve' and the movement speed Vm after the concentration increases. In the present exemplary embodiment, the ink is discharged when the relative positional relationship between the recording head 105 and the recording medium P corresponds to the position 403.

As described above, even in the case in which the concentration in the circulation channels is increased, it is possible to reduce a deviation of the landing position of the ink by adjusting the ink discharge timing to an earlier timing than that in the case in which the concentration is not increased.

In view of the above-described points, the discharge timing adjustment is performed according to the concentration in the circulation channels in the present exemplary embodiment.

Figure 14:
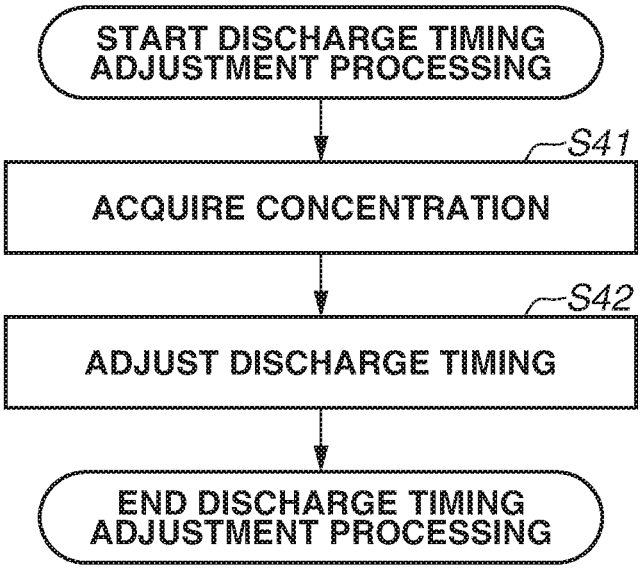
FIG. 14 is a flowchart illustrating a discharge timing adjustment according to an exemplary embodiment.

FIG. 14 is a flowchart illustrating a process of adjusting a discharge timing which is executed by the control program in the present exemplary embodiment. This process of adjusting a discharge timing can be performed at various timings. For example, the process can be performed each time the concentration N (x+1) is calculated (updated) or can be performed for each job or each page.

If the process of adjusting a discharge timing is started, then in step S41, information indicating the concentration N (x+1) calculated as described above is acquired.

Next, in step S42, the timing to discharge each ink is adjusted based on the concentration information. In the discharge timing adjustment in step S42, a table which defines the correspondence relationship between the concentrations and the discharge timings as illustrated in FIG. 11 described below is referred, and a discharge timing adjustment value corresponding to the concentration information acquired in step S41 is selected for each ink.

Thereafter, the process of adjusting a discharge timing is ended.

FIG. 11 illustrates the correspondence relationship between the concentrations and the ink discharge timings in the present exemplary embodiment.

In the present exemplary embodiment, a reference timing is stored for each ink in the memory. The reference timing is set such that each ink lands in an ideal position and the landing positions of the respective inks are aligned unless there is a change in the concentration, and a specific value of the timing is preset at the time of the manufacture of the recording apparatus, etc.

Furthermore, if the concentration N (x+1) calculated for each ink according to the flowchart in FIG. 9 is less than a predetermined threshold value, the discharge timing adjustment value is set to "0", i.e., the discharge timing is not changed from the reference timing. Since the decrease in the concentration is not significant, substantially no decrease in the discharge speed occurs, and discharging the ink at the reference timing is not likely to cause a deviation of the ink landing position as illustrated in FIG. 10A.

On the other hand, in the case in which the concentration N (x+1) is not lower than the predetermined threshold value, the discharge timing adjustment value is set to "−1", i.e., the discharge timing is adjusted to an earlier timing than the reference timing. The reason is as follows. As the concentration decreases, the discharge speed also decreases, and the ink is discharged at an earlier timing than the reference timing as illustrated in FIG. 10C to reduce the deviation of the ink landing position as illustrated in FIG. 10B.

In the present exemplary embodiment, various methods are applicable as a specific method of adjusting the ink discharge timing.

For example, the recording apparatus in the present exemplary embodiment applies the same driving pulse to the plurality of recording elements forming the recording element array to discharge the ink. In view of this point, the ink discharge timing can be adjusted to an earlier timing by performing control to temporally shift the timing to apply the driving pulse to an earlier timing.

Further, the recording apparatus in the present exemplary embodiment discharges the ink according to recording data which specifies that the ink is to be discharged or not to be discharged with respect to each pixel sectioned by each column (raster) extending in the X-direction and each row (column) extending in the Y-direction. In view of this point, it is possible to adjust the ink discharge timing to an earlier timing by performing control to offset the recording data in the negative X-direction.

As described above, the ink discharge timing is adjustable to an earlier timing by performing control to shift the timing to apply the driving pulse or control to offset the recording data in the present exemplary embodiment.

As illustrated in FIG. 11, while the predetermined threshold values for the cyan, magenta, and yellow inks are each set to a concentration of 7.5%, the predetermined threshold value for the black ink is set to a concentration of 8%. The reason is that the concentration of the black ink at the time when the concentration is not increased, i.e., the original concentration of the black ink, is higher than those of the other inks.

The reference timing is adjusted such that no deviation of the ink landing position occurs if the ink has the original concentration and is discharged at the reference timing. Thus, not the absolute value of the concentration but the amount of change in the concentration from the original concentration needs to be used to determine the level of a decrease in the discharge speed caused by an increase in the concentration. Since the original concentration of the black ink is higher than those of the other inks, when the inks are compared when they reach the same concentration, the amount of change in the concentration of the black ink is smaller than those of the other inks. Thus, the predetermined threshold value for the black ink is set greater than those for the other inks to cancel the effect of the original concentration which is high.

While whether to perform the discharge timing adjustment is determined using the absolute value of the concentration in the present exemplary embodiment, the amount of change from the original concentration can be calculated to perform the discharge timing adjustment using the calculated amount of change.

As described above, the present exemplary embodiment makes it possible to prevent a deviation of the ink landing position by adjusting the ink discharge timing according to the concentration in the circulation channels even in the case in which the concentration increases in the circulation channels and a deviation of the ink landing position can occur.

A second exemplary embodiment will be described below. In the first exemplary embodiment described above, an example in which the ink discharge timing is adjusted to prevent a deviation of the ink landing position which is caused by an increase in the ink concentration in the circulation channels is described.

In the present exemplary embodiment, on the other hand, the form will be described below in which the distance between the recording head and the recording medium (hereinafter, also referred to as "head-to-medium distance") is adjusted to prevent a deviation of the ink landing position which is caused by an increase in the ink concentration in the circulation channels. Specifically, control is performed such that the head-to-medium distance is adjusted to enable the inks of the respective colors to land in ideal positions even when the concentrations of some of the inks are increased so that the inks of the respective colors land onto the same position.

Description of those that are similar to those in the first exemplary embodiment described above is omitted.

In the present exemplary embodiment, the recording heads 105 to 108 are attached to the recording apparatus such that each of the recording heads 105 to 108 is individually movable in the Z-direction.

Figure 12A:
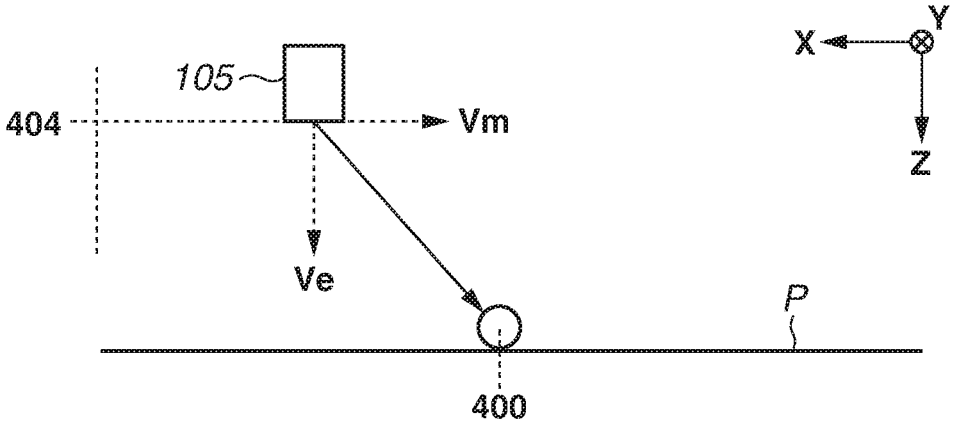
FIGS. 12A, 12B, and 12C illustrate a head-to-medium distance adjustment according to an exemplary embodiment.
Figure 12B:
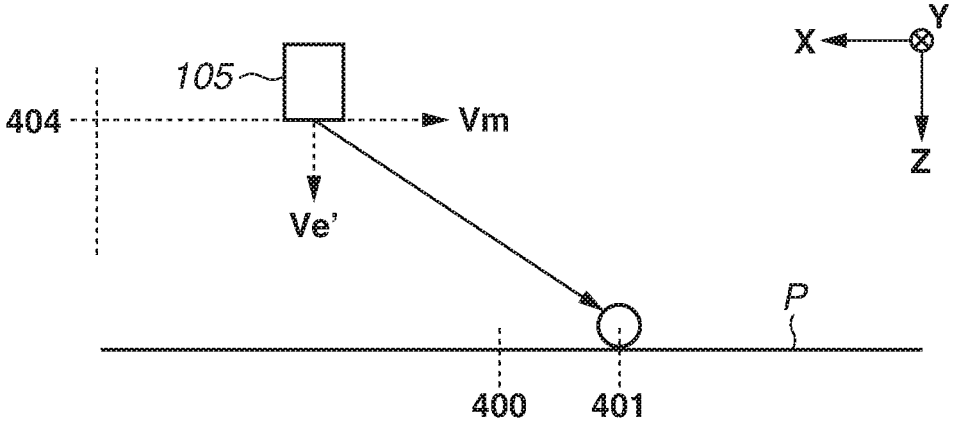
Figure 12C:
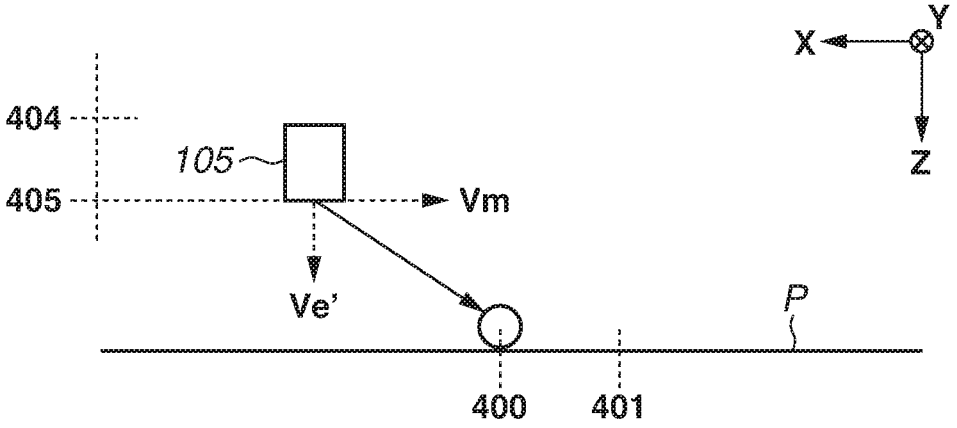

FIGS. 12A to 12C illustrate a deviation of the ink landing position which is caused by the ink concentration in the circulation channels and a correction of a deviation of the landing position by adjusting the head-to-medium distance in the present exemplary embodiment. To simplify descriptions, only a discharge from the recording head 105 among the recording heads 105 to 108 is illustrated. Further, while FIG. 1 illustrates the form in which the recording apparatus performs a recording operation while conveying the recording medium P in the positive X-direction, FIGS. 12A to 12C illustrate the form in which a recording operation is performed while the recording head 105 is moved in the negative X-direction to simplify descriptions. The two forms described above are substantially the same from the point of view of the relative relationship between the recording medium P and the recording head 105. Further, the ink discharge timings in FIGS. 12A to 12C are assumed to be the same timings in the present exemplary embodiment.

FIG. 12A illustrates how the ink lands when the concentration is not increased significantly in the circulation channels and the ink discharge speed is not decreased. The case in FIG. 12A is similar to the case illustrated in FIG. 10A except that the position of the recording head 105 in the Z-direction is specified.

At this time, the recording head 105 is positioned at a position 404 in the Z-direction. The reason is that an ink drop discharged at the position 404 can land in the ideal position 400 if the ink is discharged in the direction of the vector sum of the discharge speed Ve and the movement speed Vm.

FIG. 12B illustrates how the ink lands when the concentration in the circulation channels increases and the ink discharge speed decreases significantly. The case in FIG. 12B is similar to the case illustrated in FIG. 10B except that the position of the recording head 105 in the Z-direction is specified.

In this case, if the ink is discharged from the recording head 105 in the position 404 the same as that in FIG. 12B, the ink lands at the position 401 deviated from the ideal position 400 on the recording medium P in the negative X-direction, not as in FIG. 12A.

FIG. 12C illustrates how the ink lands when the head-to-medium distance adjustment in the present exemplary embodiment is performed in the case in which the concentration in the circulation channels is increased.

In the present exemplary embodiment, when the concentration in the circulation channels is increased, the head-to-medium distance is adjusted to lower the position of the recording head 105 in the Z-direction (move the position of the recording head 105 in the positive Z-direction) such that the head-to-medium distance becomes shorter than that in the case in which the concentration is not increased.

In the present exemplary embodiment, as illustrated in FIG. 12C, in the case in which the concentration in the circulation channels is increased, the recording head position is lowered to reduce the head-to-medium distance such that the ink is discharged at a position 405 which is further deviated in the positive Z-direction (i.e., which is further deviated to the lower side in the Z-direction) than that in the case in which the concentration is not increased. The position 405 is such a position that an ink drop lands in the ideal position 400 when the ink is discharged in the direction of the vector sum of the discharge speed Ve' and the movement speed Vm after the concentration is increased.

As described above, even in the case in which the concentration in the circulation channels is increased, a deviation of the ink landing position can be also reduced by reducing the head-to-medium distance to a shorter distance than that in the case in which the concentration is not increased.

In view of the above-described aspects, the head-to-medium distance is adjusted according to the concentration in the circulation channels in the present exemplary embodiment.

Figure 15:
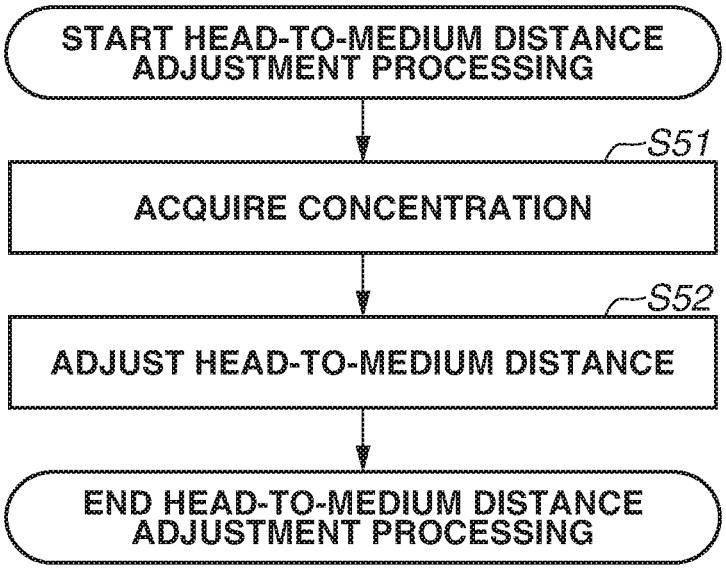
FIG. 15 is a flowchart illustrating a head-to-medium distance adjustment according to an exemplary embodiment.

FIG. 15 is a flowchart illustrating a process of adjusting the head-to-medium distance which is executed by the control program in the present exemplary embodiment. This process of adjusting the head-to-medium distance can be performed at various timings. For example, the process can be performed each time the concentration N (x+1) is calculated (updated) or can be performed for each job or each page.

If the process of adjusting the head-to-medium distance is started, then in step S51, information indicating the concentration N (x+1) calculated as described above is acquired.

Next, in step S52, the head-to-medium distance of each of the recording heads corresponding to the respective inks is adjusted based on the concentration information. In the head-to-medium distance adjustment in step S52, a table which defines the correspondence relationship between the concentrations and the head-to-medium distances as illustrated in FIG. 13 is referred, and the head-to-medium distance adjustment value corresponding to the concentration information acquired in step S51 is selected for each ink.

Thereafter, the process of adjusting the head-to-medium distance is ended.

FIG. 13 illustrates the correspondence relationship between the concentrations and the head-to-medium distances in the present exemplary embodiment.

In the present exemplary embodiment, a reference head-to-medium distance is stored for each ink in the memory. The reference head-to-medium distance is such a distance that each ink lands in an ideal position and the landing positions of the respective inks are aligned unless there is a change in the concentration, and a specific value of the head-to-medium distance is preset at the time of the manufacture of the recording apparatus.

Based on the foregoing, if the concentration N (x+1) calculated for each ink according to the flowchart in FIG. 9 is less than a predetermined threshold value, the head-to-medium distance is set to a relatively long distance h1 which corresponds to the reference head-to-medium distance because of the following reason. Since the decrease in the concentration is not significant, substantially no decrease in the discharge speed occurs. Thus, even if the ink is discharged at the head-to-medium distance as illustrated in FIG. 12A, a deviation of the ink landing position is not likely to occur.

On the other hand, in the case in which the concentration N (x+1) is equal to or greater than the predetermined threshold value, the head-to-medium distance is set to h2 (<h1). Specifically, the recording head is moved in the positive Z-direction such that the head-to-medium distance becomes shorter than the reference head-to-medium distance. When the concentration is decreased, the discharge speed is decreased, so that the ink is discharged from the short head-to-medium distance as illustrated in FIG. 12C to prevent a deviation of the ink landing position as illustrated in FIG. 12B.

The predetermined threshold value (8%) for the black ink is higher than those (7.5%) for the other inks also in FIG. 13, and the reason therefor is similar to that described above with reference to FIG. 11 in the first exemplary embodiment.

As described above, the present exemplary embodiment is capable of preventing a deviation of the ink landing position by adjusting the head-to-medium distance according to the concentration in the circulation channels even in the case in which the concentration increases in the circulation channels and a deviation of the ink landing position can occur.

(Other Exemplary Embodiment)

While the form in which the cyan, magenta, yellow, and black inks are discharged from the different recording heads 105 to 108 is described in the above-described exemplary embodiments, any other forms can also be adopted. The cyan, magenta, yellow, and black inks can be discharged from a single recording head. Further, discharge port arrays for respectively discharging the cyan, magenta, yellow, and black inks can be disposed in the same heater board.

Further, while the exemplary embodiments describe the forms in which the discharge timing or the head-to-medium distance is adjusted such that the ink landing position is the ideal position in a case where the concentration increases, the adjustment does not necessarily have to be performed to adjust the ink landing position to be the ideal position. For example, even in a case where the landing position is deviated from the ideal position, the image quality is not likely to deteriorate significantly if the ink landing positions for each ink color are aligned. For example, if it is found that the landing positions of the cyan, magenta, and yellow inks are deviated from the ideal positions by a similar amount and the landing position of the black ink is the ideal position as a result of calculation of concentrations, the landing position of the black ink which is the ideal position is adjusted to the landing positions of the cyan, magenta, and yellow inks. An exemplary embodiment is applicable to various adjustments of the landing position according to the concentration as described above, such as adjustment to an ideal position or adjustment between colors.

Further, while the first exemplary embodiment describes the form in which the ink discharge timing is adjusted to correct the ink landing position and the second exemplary embodiment describes the form in which the head-to-medium distance is adjusted to correct the ink landing position, the forms can be executed in combination. Specifically, in the case in which the concentration is increased, even if the ink discharge timing is adjusted to an earlier timing while the head-to-medium distance is reduced, an advantage similar to that produced by the exemplary embodiments can be produced if the head-to-medium distance and the discharge timing are each adjusted such that the inks land in the ideal positions.

Further, while the form in which the recording heads 105 to 108 are individually movable in the Z-direction is described in the second exemplary embodiment, the recording heads 105 to 108 can be movable integrally. In this case, if the concentrations of only some of the inks are increased, it is not possible to adjust the head-to-medium distances with respect to only the recording heads of the inks. For example, in the case in which the concentrations of the cyan, magenta, and yellow inks are not increased and the cyan, magenta, and yellow inks can land in the ideal positions from the reference head-to-medium distances while the concentration of the black ink is increased and the ink landing position is deviated, it is not possible to move only the recording head 108 of the black ink. Further, if the recording heads 105 to 108 are integrally moved to uniformly reduce the head-to-medium distances so that a deviation of the landing position of the black ink is prevented, the landing position of the black ink is no longer deviated. However, the landing positions of the cyan, magenta, and yellow ink, which are not deviated in the case of the reference head-to-medium distances, will deviate. However, even in this case, since the discharge speeds (Ve) of the cyan, magenta, and yellow inks are higher than the discharge speed (Ve') of the black ink, the level of the landing position deviations as a result of reducing the head-to-medium distances is smaller than the level of the deviation of the landing position of the black ink in the case of the reference head-to-medium distance. Thus, even in the form in which the recording heads 105 to 108 are integrally moved, if the concentration of any of the inks is increased, the influence of the landing position deviation is reduced to some extent by uniformly reducing the head-to-medium distances. Further, the landing position deviations of the cyan, magenta, and yellow inks occurring as a result of reducing the head-to-medium distances can be prevented by adjusting the ink discharge timings as in the first exemplary embodiment.

Further, while the forms in which the recording heads which are longer than the width of a recording medium are used, and recording is performed while the recording medium is conveyed is described in the above exemplary embodiments, any other forms are also adoptable. For example, a recording operation in which ink is discharged while the recording heads scan in the direction that intersects with the array direction in which the discharge ports are aligned, and a conveyance operation in which the recording medium is conveyed in the array direction during a scan may be repeatedly performed to complete recording on the recording medium through a plurality of times of scanning (movements).

The recording apparatuses according to exemplary embodiments are capable of suitably correcting deviations of ink landing positions which are caused by ink concentration in circulation channels.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-115989, filed Jun. 13, 2017, which is hereby incorporated by reference herein in its entirety.

What is claimed is:

1. A recording apparatus comprising:

a recording head including a plurality of discharge ports for discharging ink on a recording medium according to a timing and a pressure chamber being in communication with the plurality of discharge ports;

a circulation channel being in communication with the pressure chamber to circulate ink between the pressure chamber and an external portion thereof so that ink is supplied to and collected from the pressure chamber;

a concentration acquisition unit configured to acquire concentration information about an ink concentration in the circulation channel;

an adjustment unit configured to adjust the timing to discharge ink based on the concentration information; and a control unit configured to control a recording operation of recording by discharging ink from the recording head such that ink is discharged at the adjusted timing, wherein a landing position of ink on the recording medium is corrected by the adjusted timing of discharging ink.

2. The recording apparatus according to claim 1, wherein the adjustment unit adjusts the timing to discharge ink such that ink is discharged at a first timing in a case where a concentration specified by the concentration information is lower than a predetermined threshold value, and ink is discharged at a second timing which is earlier than the first timing in a case where the concentration specified by the concentration information is higher than the predetermined threshold value.

3. The recording apparatus according to claim 2, wherein the first timing is a predetermined reference timing, and wherein the second timing is a timing corrected to be earlier by a predetermined time than the reference timing.

4. The recording apparatus according to claim 2, further comprising:

the recording head configured to discharge a first ink; and the recording head configured to discharge a second ink having a higher concentration than a concentration of the first ink, wherein the predetermined threshold value corresponding to the second ink is larger than the predetermined threshold value corresponding to the first ink.

5. The recording apparatus according to claim 1, further comprising:

a consumption amount acquisition unit configured to acquire consumption amount information about an amount of ink consumption by the recording operation by the control unit; and an evaporation amount acquisition unit configured to acquire evaporation amount information about an amount of ink evaporation from the recording head before and after the recording operation by the control unit, wherein the concentration acquisition unit acquires the concentration information based on the consumption amount information and the evaporation amount information.

6. The recording apparatus according to claim 5, further comprising an initial amount acquisition unit configured to acquire initial amount information about an initial amount of ink existing in the circulation channel, wherein the concentration acquisition unit acquires the concentration information based on the consumption amount information, the evaporation amount information, and the initial amount information.

7. The recording apparatus according to claim 1, wherein the recording head further includes a plurality of recording elements which is disposed in a position facing the plurality of discharge ports and generates energy for discharging ink in response to a driving pulse applied to each of the plurality of recording elements, and wherein the adjustment unit adjusts the timing to discharge ink by adjusting a timing to apply the driving pulse to each of the plurality of recording elements.

8. The recording apparatus according to claim 1, further comprising a generation unit configured to generate recording data for use in the recording operation by the control unit, wherein the adjustment unit adjusts the timing to discharge the ink by adjusting the recording data.

9. The recording apparatus according to claim 1, further comprising an ink tank configured to store ink, wherein the circulation channel is for circulating the ink between the pressure chamber and the ink tank.

10. A recording method using:

a recording head including a plurality of discharge ports for discharging ink on a recording medium according to a timing and a pressure chamber being in communication with the plurality of discharge ports; and a circulation channel being in communication with the pressure chamber to circulate ink between the pressure chamber and an external portion thereof so that the ink is supplied to and collected from the pressure chamber, the method comprising:

acquiring concentration information about an ink concentration in the circulation channel;

adjusting the timing to discharge ink based on the concentration information; and controlling a recording operation of recording by discharging the ink from the recording head such that ink is discharged at the adjusted timing, wherein a landing position of ink on the recording medium is corrected by the adjusted timing of discharging ink.

11. A recording apparatus comprising:

a recording head including a plurality of discharge ports for discharging ink on a recording medium according to a timing, ink supply openings for supplying ink to the plurality of discharge ports, and ink collection openings for collecting ink supplied from the ink supply openings;

a circulation channel configured to circulate ink between the recording head and an external portion;

a concentration acquisition unit configured to acquire concentration information about an ink concentration in the circulation channel;

an adjustment unit configured to adjust the timing to discharge ink based on the concentration information; and a control unit configured to control a recording operation of recording by discharging ink from the recording head such that ink is discharged at the adjusted timing, wherein a landing position of ink on the recording medium is corrected by the adjusted timing of discharging ink.

* * * * *